US005735379A

United States Patent [19]

Schulze et al.

[11] Patent Number: 5,735,379

[45] Date of Patent: Apr. 7, 1998

[54] MONEY-OPERATED ENTERTAINMENT DEVICE

[75] Inventors: Ullrich Schulze, Wiesbaden; Horst Niederlein, Bingen; Andreas Buchholz, Muenster-Sarmsheim, all of Germany

[73] Assignee: NSM Aktiengesellschaft, Bingen, Germany

[21] Appl. No.: 602,770

[22] PCT Filed: Sep. 3, 1994

[86] PCT No.: PCT/DE94/01014

§ 371 Date: May 29, 1996

§ 102(e) Date: May 29, 1996

[87] PCT Pub. No.: WO95/07519

PCT Pub. Date: Mar. 16, 1995

[30] Foreign Application Priority Data

Sep. 4, 1993 [DE] Germany ..... 43 29 945.8
Jun. 27, 1994 [DE] Germany ..... 44 22 369.2

[51] Int. Cl.[6] ..... G07F 17/34

[52] U.S. Cl. ..... 194/346; 194/352; 453/17

[58] Field of Search ..... 194/352, 346; 453/17, 18, 29; 273/143 R, 142 H, 142 HA; D21/38

[56] References Cited

U.S. PATENT DOCUMENTS 3,605,970 9/1971 de Crepy ..... 194/346
4,342,384 8/1982 Fukase et al. ..... 453/56

FOREIGN PATENT DOCUMENTS 0291305 4/1987 European Pat. Off. .
4201314 10/1992 Germany .
2147442 5/1985 United Kingdom .
91/16693 10/1991 WIPO .

OTHER PUBLICATIONS

*Owner's Pictorial Guide for the Care and Understanding of the Jennings Bell Slot Machine*, Mead Publishing Corp. CA. Aug. 1981, Robert N. Geddes et al. pp. 97–105, 145, 146 and 150.

*Primary Examiner*—F. J. Bartuska
*Attorney, Agent, or Firm*—Spencer & Frank

[57] ABSTRACT

A computer-controlled entertainment device operated with at least one of money and money equivalents includes: a housing; a plurality of viewing windows disposed on the housing; a symbol game arrangement for displaying winning and losing symbol combinations including a plurality of rotating bodies disposed in the housing behind respective ones of the viewing windows; an optionally selectable additional prize game arrangement for one of playing to completion and accumulating a prize won in the symbol game arrangement; a money processing arrangement including a value specific stacking arrangement for items of value, a prize delivery arrangement operatively connected to the stacking arrangement and comprising at least one collection bin for the items of value, the collection bin being configured such that a filling level thereof is visible from a region outside the entertainment device; a computer control arrangement for filling the collection bin with items of value up to a final total value which is one of predetermined by a computer and fixed by random control at the stacking arrangement; a storage bin integrated in the housing so as to be in communication with the collection bin; an arrangement for filling the collection bin from the storage bin; and an arrangement for filling the collection bin manually.

35 Claims, 11 Drawing Sheets

MONEY-OPERATED ENTERTAINMENT DEVICE

FIELD OF THE INVENTION

The invention relates to a computer-controlled entertainment device which is operated with money or money equivalents, with a symbol game means which displays a combination of symbols which decides on winning or losing on rotating bodies behind the pertinent viewing windows, and with a money processing means to which a prize delivery means is assigned.

BACKGROUND OF THE INVENTION

Entertainment devices of this type are used in the most varied embodiments. They generally have three rotating bodies which can be made in the form of rollers or disks. On the surface which can be viewed from outside through viewing windows the rotating bodies bear symbols. The rotating bodies are randomly controlled, and, after all rotating bodies have come to rest, the symbol combination displayed in the viewing windows indicates a win or loss. Money and special game prizes are promised at different levels. For the special game prizes a prize key with a chance of winning which is increased compared to normal play is used.

Various measures have been taken to induce a player to use these entertainment devices, also to entertain him while playing, and to impart additional inducements to play. Therefore actuating elements which generally act on the movement of individual rotating bodies are attached to many of these entertainment devices for the player. Thus the player can be enabled to start one or more rotating bodies by actuating one such actuating element, for example, a start button, by which the player is given a real influence on the playing event. There are also stop buttons in order to enable the player to stop a turning rotating body, by which the player acquires the impression of being able to influence the playing event and thus the symbol combination which results while playing.

To make the game more varied, additional prize game means are known which can be made as risk game means which enable the player, risking a loss, to increase the already won prize or additional prize, or as wagering means which enable the player to increase or decrease the already won prize without the danger of complete loss. Other game inducements with additional winning potential are represented by a light border which is used as the jackpot and which is composed of several prize display elements. When a certain prize is won a certain prize display element is illuminated which bears a symbol which is referenced to the prize won. When all prize display elements of the light border are illuminated, an additional prize is indicated. The light border can also consist of neutral display elements which can be illuminated and which are each illuminated in series when a game is won, and when all are illuminated trigger the additional prize. In these jackpot light borders the player is therefore notified via display means what additional prize, which can also be a monetary prize, he can win. In doing so however the player does not realistically see how a possible monetary prize increases as the light border is completed, i.e., the player does not see the increase of the coins which comprise the possible monetary prize.

SUMMARY OF THE INVENTION

The object of the invention is to configure an entertainment device of the initially mentioned type for purposes of enhanced inducement to play and more entertainment during the game.

This object is achieved according to the invention by the prize delivery means comprising at least one collection bin for items of value, the fill level of which can be recognized from outside the entertainment device.

This measure makes the game event much more varied since the player can now realistically recognize immediately which items of value he is in fact receiving in case of a win, and moreover the player can estimate, based on the recognizability of the fill level of the collection bin, what value the items of value represent overall. By directly recognizing the offered items of value the inducement to play is greatly increased and at the same time the entertainment value for the player is enhanced.

According to one advantageous embodiment of the invention the items of value can all be suddenly transferred via a guide channel into a delivery tray from the collection bin by opening it correspondingly. This yields an extremely fast delivery process for the items of value. Alternatively it is also possible to transfer the items of value individually or in partial amounts via a selection means which is assigned to the collection bin out of the latter via the guide channel into the delivery tray.

More advantageously the items of value are coins, currency, tokens, cards of value such as coupons or telephone cards and/or articles, of which one certain type or several types are housed in the collection bin at a time. In this way the player can be offered the same or different items of value as the prize.

To achieve simple recognizability of the items of value, according to one advantageous development of the invention it is possible to look into the collection bin and/or it is made transparent and is located behind a viewing window in the front side of the entertainment device.

Furthermore, it is preferably provided that the collection bin is used as the jackpot, prize storage, credit storage, risk storage or the like. This makes it possible to assign different functions to the collection bin according to the game system of the entertainment device.

Furthermore, in another embodiment of the invention the fill level of the collection bin can be acoustically and/or optically represented via indirect display. In this way the fill level of the collection bin is additionally or alternatively indicated to the player.

In order that the player need not add up the value of the individual items of value to determine the total value of the items of value present in the collection bin, according to one advantageous development of the solution according to the invention the actual total value content of the collection bin can be represented in a display.

In order to direct the attention of the player especially to the collection bin, according to another embodiment of the invention certain surfaces of the collection bin are colored and/or mirrored. In this case the colored and/or mirrored surfaces of the collection bin are preferably illuminated. Furthermore, preferably outside colored and/or reflection surfaces are assigned to the collection bin. In this case the colored and/or reflection surfaces assigned to the collection bin are preferably illuminated.

According to another development of the invention the items of value are located arranged in order or randomly within the collection bin. In the case of the ordered arrangement of the articles of value the player can relatively easily estimate the total value of the items of value, while this is relatively difficult in the random arrangement.

To hinder the estimation of the total value of the items of value located in the collection bin, according to one development of the invention a cover means with which the visible surface of the collection bin can be covered in its entirely or in part is assigned to it. In this case the cover means is triggered depending on the result in the symbol game means.

In order on the one hand to ensure extremely rapid emptying of the collection bin and on the other its easy filling, according to one additional embodiment the collection bin consists of two opposite scoop-shaped trays, for opening and closing of the collection bin at least one of the trays being supported to swivel and being connected to a drive, and the other tray having a feed opening.

In one alternative embodiment the collection bin is made as a hollow body of any shape and is pivotally mounted on a center axis or on its outside surface, the collection bin being provided with a feed/delivery opening, and having a turning capacity by means of a drive between an upper fill position and a lower emptying position. Here the feed/delivery opening of the collection bin can be closed. This makes it possible to have the collection bin rotate.

In another alternative embodiment of the collection bin, when the latter is made cylindrical to accommodate items of value in the form of various coins, the distance between the corresponding front and back of the collection bin is slightly larger than the thickness of the thickest coin, the distance being smaller than twice the thickness of the thinnest coin. Alternatively in one cylindrical embodiment of the collection bin for holding items of value in the form of identical coins the distance between the transparent front and back of the collection bin is slightly larger than the thickness of the coins to be stored edgewise in the collection bin. In this case there can be several cylindrical, coin value-specific collection bins arranged in succession. Alternatively several cylindrical, coin value-specific collection bins can be arranged concentrically inside one another.

Preferably the items of value of the collection bin are delivered when a stipulated fill level or one established by random control is reached. Furthermore, the items of value of the collection bin can be more advantageously delivered depending on the occurrence of a certain symbol or a certain combination of symbols in the viewing windows of the symbol game means. These measures force the player to follow the progress of the game with special interest.

In another attractive embodiment of the entertainment device, at least one additional prize game means is provided consisting of several display elements which can be illuminated and which are prize-specific. In this embodiment, a prize won in the symbol game means can be wagered, the items of value in the collection bin being deliverable preferably depending on the result achieved in the additional prize game means.

The collection bin is more advantageously filled by a transport means or by hand with items of value from at least one storage bin for the items of value. Here more advantageously the collection bin can be filled using the transport means with items of value from at least one stacking bin for specific items of value, such as coins, currency and/or tokens, which is assigned directly to the money processing means.

More advantageously a removal means for the uppermost item of value from the stacking bin with which the items of value can be transferred to the collection bin is assigned to the value-specific stacking bin, a movement means being provided for the stack of items of value within the stacking bin. Here preferably the removal site of the items of value from the stacking bin is followed by a controllable shunt via which the items of value can be routed either into the collection bin or into the delivery tray.

Another possibility for filling the collection bin according to one development of the invention consists in that a portion of the items of value inserted into the money processing means, such as coins, currency and/or tokens, is routed via a shunt, not into the stacking bin of the money processing means, but into the collection bin. More advantageously here the shunt which is connected downstream of the tester of the money processing means is followed by an intermediate storage from which the items of value by corresponding opening of the storage can be transferred suddenly or by means of a pertinent selection means into the collection bin. Furthermore, the collection bin can be filled if a portion of the items of value inserted into the money processing means, such as coins, currency and/or tokens, is routed into the collection bin via a transport means with upstream shunt, the transport means being assigned to the delivery means of the money processing means. Furthermore it can be preferably provided that a portion of the items of value inserted into the money processing means, such a coins, currency and/or tokens, can be transferred into the collection bin via a shunt downstream of the tester, with or without a downstream intermediate storage and via a transport means which is assigned to the delivery means of the money processing means, with upstream shunt. The transport means can be made as a single or double conveyor belt or as a scoop conveyor. The intermediate storage downstream of the shunt can be made as a hopper or as a tubular storage.

One special game inducement is when the collection bin can be filled with at least one item of value depending on the appearance of a certain symbol or a certain combination of symbols in the viewing windows of the symbol game means. More advantageously the collection bin is filled with articles of value up to a stipulated total value amount or one which has been established by random control.

In another alternative embodiment of the entertainment device, when the items of value are delivered from the collection bin, they are transferred not into the delivery tray, but into a depository which is not visible and instead items of equal value are routed from the stacking bins of the money processing means into the delivery tray. Then preferably the collection bin is re-filled with items of value from the depository, by which a closed cycle of these items of value is ensured. This reliably precludes the feed of unallowable items of value into the collection bin.

It goes without saying that the aforementioned features to be explained below can be used not only in the combination indicated at the time, but also in other combinations or alone, without departing from the framework of this invention.

BRIEF DESCRIPTION OF THE DRAWINGS

The idea underlying the invention is detailed in the following description using several embodiments which are shown in the drawings.

DETAILED DESCRIPTION OF THE INVENTION

Figure 1:
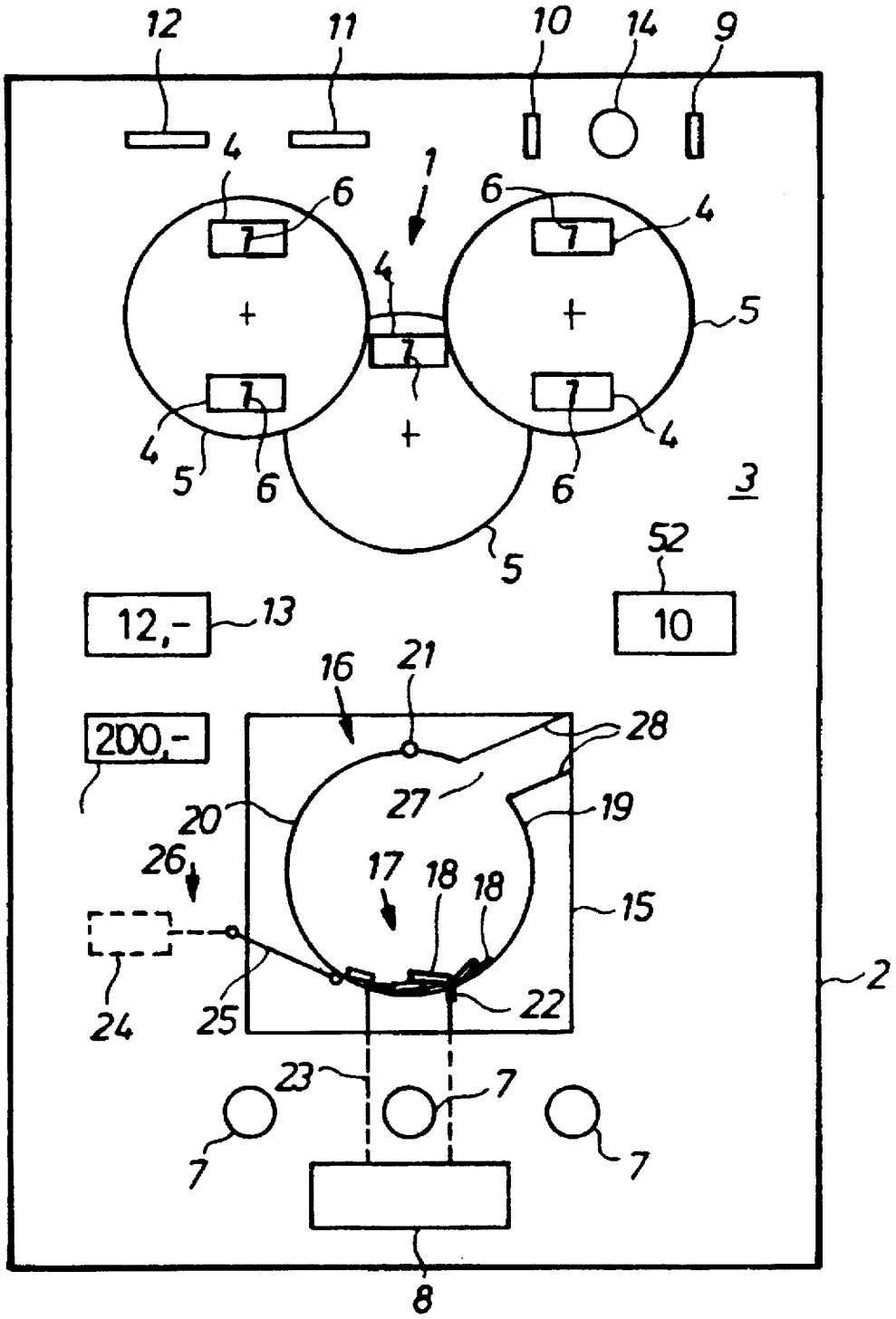
FIG. 1 shows a front view of an entertainment device according to the invention with a visible collection bin for items of value.

Housing 2 of the entertainment device with a win possibility which is provided with a computer-controlled control unit, the housing accommodating symbol game means 1, on its front 3 has viewing windows 4, behind which there are three successive disk-shaped rotating bodies 5 of symbol game means 1. The computer determines the entire progress of the game including the prize determination and prize delivery. The control and computer functions are executed according to the computer programs which can be matched to all necessary functions. Rotating bodies 5 are stopped after the game begins during or at the end of the game by a random event generator assigned to the control unit in a plurality of possible catch positions. Symbols 6 which are used for display of the game result in viewing windows 4 are assigned to the catch positions on the periphery of rotating bodies 5. From displayed symbols 6 the player can read the game result, especially also whether there has been a win according to the win plan explained on front 3 from a combination of displayed symbols 6.

In the bottom area of the entertainment device are several actuating elements 7 with which symbols 6 displayed in symbol game means 1 can be stopped or re-started. Under actuating elements 7 is delivery tray 8 for the prizes won. In the upper area of the entertainment device are coin insertion slot 9, token insertion slot 10, currency input slot 11 and user card insertion slot 12 of a money processing means which is not detailed.

On the left side under symbol game means 1 there is a credit display 13; its displayed credit can be called up into delivery tray 8 by actuating return key 14 which is next to coin insertion slot 9. On the right side under symbol game means 1 is attached special game display 52 in which special games attained in symbol game means 1 in which a prize key with an increased chance of winning is used are represented.

Furthermore, there is rectangular viewing window 15 inset into front pane 3 of housing 2; behind the window is transparent collection bin 16 for items of value 17 in the form of coins 18, especially silver coins of different value. Collection bin 16 is composed of two opposite scoop-like trays 19, 20, scoop 19 being stationary and tray 20 being mounted to swivel in articulation 21 attached to tray 19. The periphery of movable tray 20 is somewhat larger than the periphery of stationary tray 19. Guide channel 23 via which items of value 17 reach delivery tray 8 suddenly when tray 20 is separated from tray 19 is assigned to bearing site 22 of trays 19, 20. Opening and closing of collection tray 16 takes place via drive 26 consisting of electromagnet 24 and lever rod 25. In the upper area of stationary tray 19 feed opening 27 is inset for items of value 17. Transport means 28 is assigned to inlet feed 27 and via it (transport means 20) the items of value can be delivered into collection bin 16 from a separate storage bin and/or a value-specific stacking bin of the money processing means.

Figure 2:
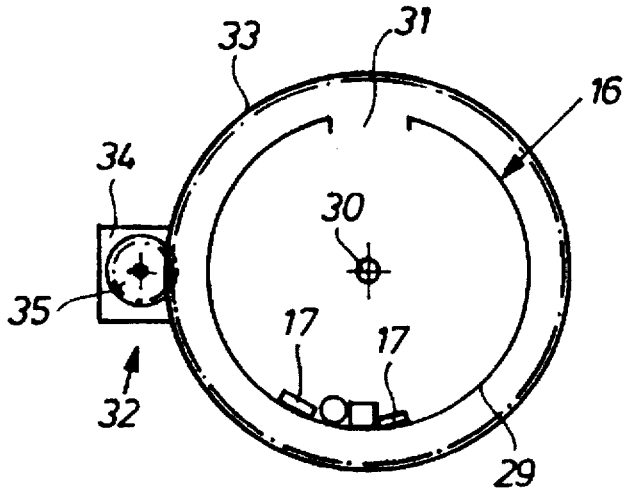
FIG. 2 shows one alternative embodiment of the collection bin of the entertainment device according to FIG. 1.

In the alternative embodiment of collection bin 16 shown in FIG. 2, the bin is made as spherical bin 29 which is pivotally mounted on axis 30. Spherical bin 29 is provided with common input/output opening 31 for items of value 17. Via drive 32 which consists of gear 33 located torsionally strong on axis 30 and gear 35 which sits torsionally strong on the shaft of drive motor 34 and which engages gear wheel 33, input/output opening 31 of spherical bin 29 can be swivelled into an upper position to hold items of value 17 and into a lower position for sudden delivery of items of value 17. Instead of spherical bin 29 a cylindrical drum can also be used.

Figure 3:
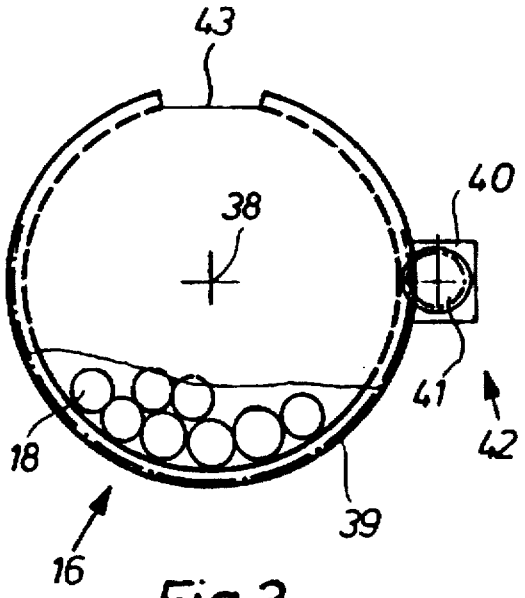
FIG. 3 shows another alternative embodiment of the collection bin of the entertainment device according to FIG. 1.
Figure 4:
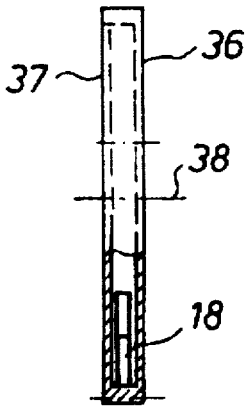
FIG. 4 shows a side view of the collection bin according to FIG. 3.
Figure 5:
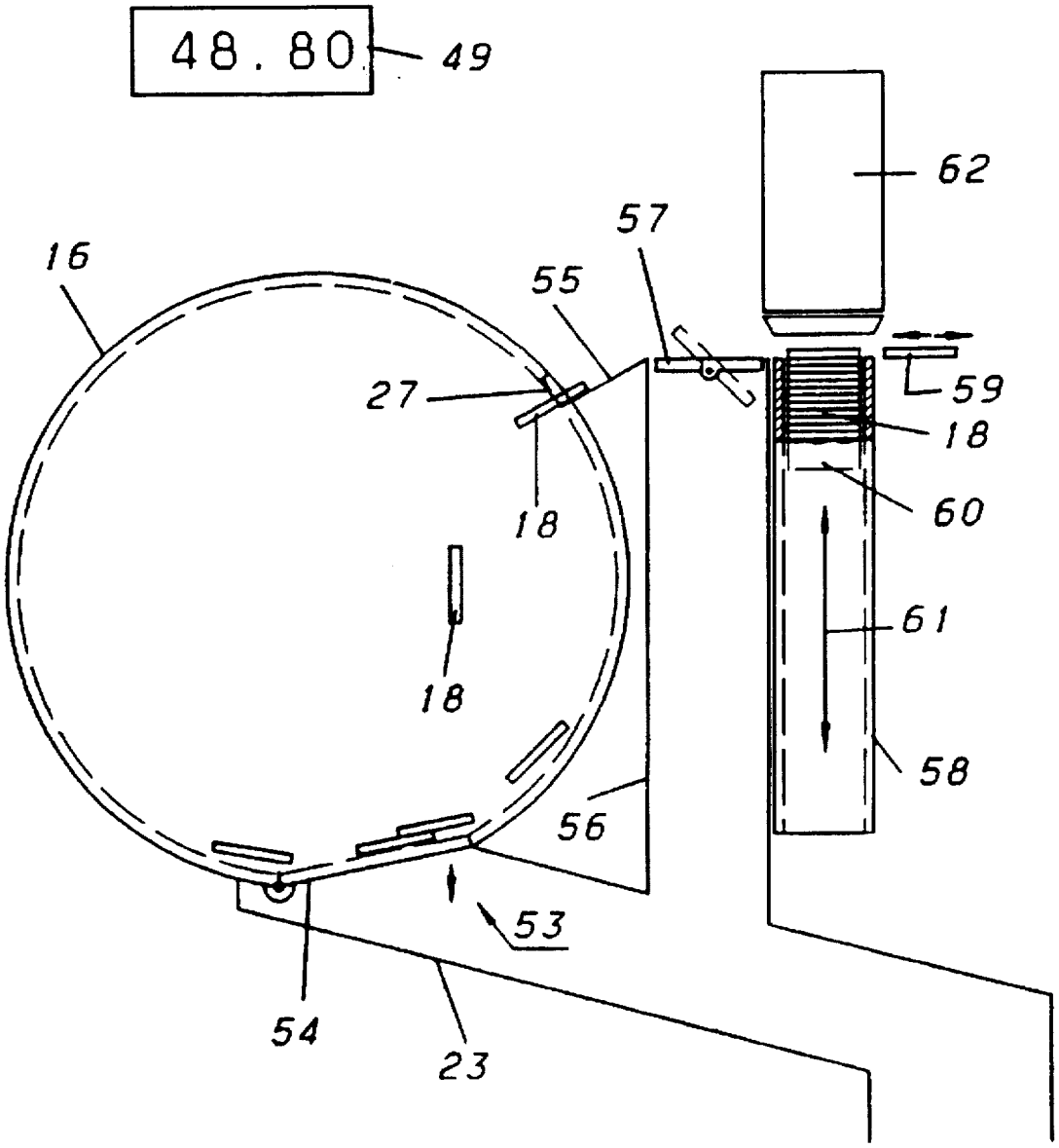
FIG. 5 shows one alterative embodiment of the collection bin of the entertainment device according to FIG. 1 with an assigned stacking bin for items of value in the form of coins.

In the embodiment of collection bin 16 which is shown in FIGS. 3 and 4, the bin is made cylindrical and is designed to hold items of value 17 in the form of coins 18 of equal value, the distance of transparent front 36 and rear 37 of the collection bin which are aligned parallel to front side 3 being slightly larger than the thickness of equivalent coins 18 which are housed accordingly edgewise on top of one another in collection bin 16. In the case of mixed, therefore coins 18 of different value, the distance between transparent front 36 and back 37 of collection bin 16 must be slightly greater than the thickness of the thickest coin and the distance must be less than twice the thickness of the thinnest coin. Cylindrical collection bin 16 is mounted to turn on center axle 38 and on its outside is provided with gear rim 39 which engages gear wheel 41 which sits torsionally strong on the shaft of drive motor 40. By means of drive 42 formed in this way input/output opening 43 which is inset into collection bin 16 can be swivelled into an upper filling position and a lower delivery position for coins 18. Alternatively collection bin 16 can also be supported on its outside. Furthermore, drive can take place alternatively via the center axis of collection bin 16.

FIGS. 5 through 9 show different feed possibilities of collection bin 16. In the representation according to FIG. 5 stationary, drum-shaped collection bin 16 is provided with input opening 27 which is located to the side at the top, and underlying output opening 53 which can be closed by controllable flap 54. Guide channel 23 to delivery tray 8 abuts output opening 53. Input opening 27 is connected to inlet channel 55 which is joined on its other end to drop tube 56 which discharges into guide channel 23. Adjustable shunt 57 which closes flush with its top is inserted into drop tube 56. Next to the drop tube is stacking bin 58 for coins 18 of equal value.

Removal means 59 for uppermost coin 18 from stacking bin 58 and its transfer to shunt 57 is assigned to stacking bin 58. Depending on the position of shunt 57 coin 18 can be routed either into drop tube 56 or collection bin 16. The stack of coins within stacking bin 58 is supported on support plate 60 which can be moved up and down in the direction of double arrow 61 by means of a moving means which is not shown. Above stacking bin 58 is coin tester 62 of the money processing means via which stacking bin 58 can be supplied with coins.

Figure 6:
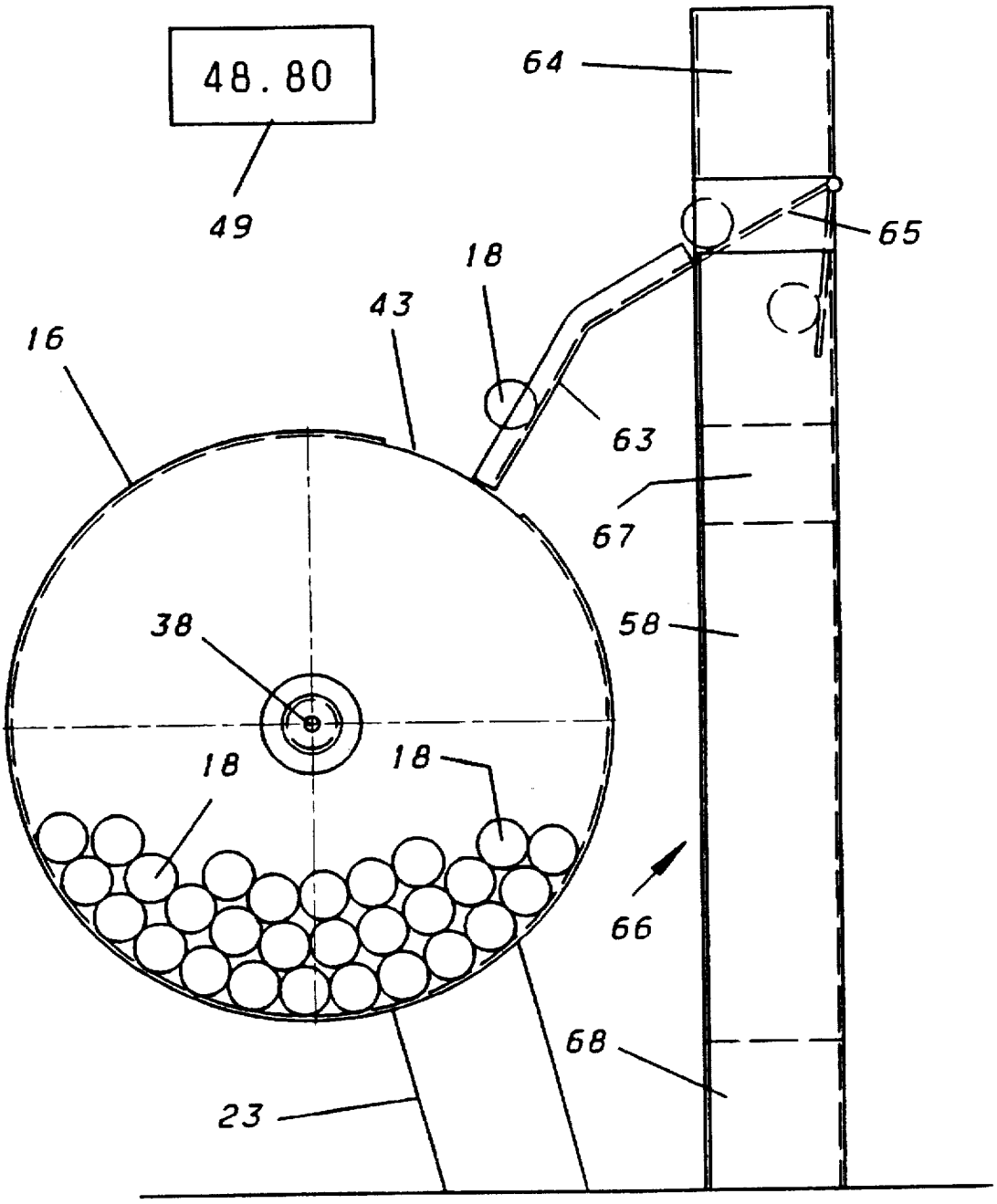
FIG. 6 shows the collection bin according to FIG. 3 with an assigned coin system of the money processing means.
Figure 7:
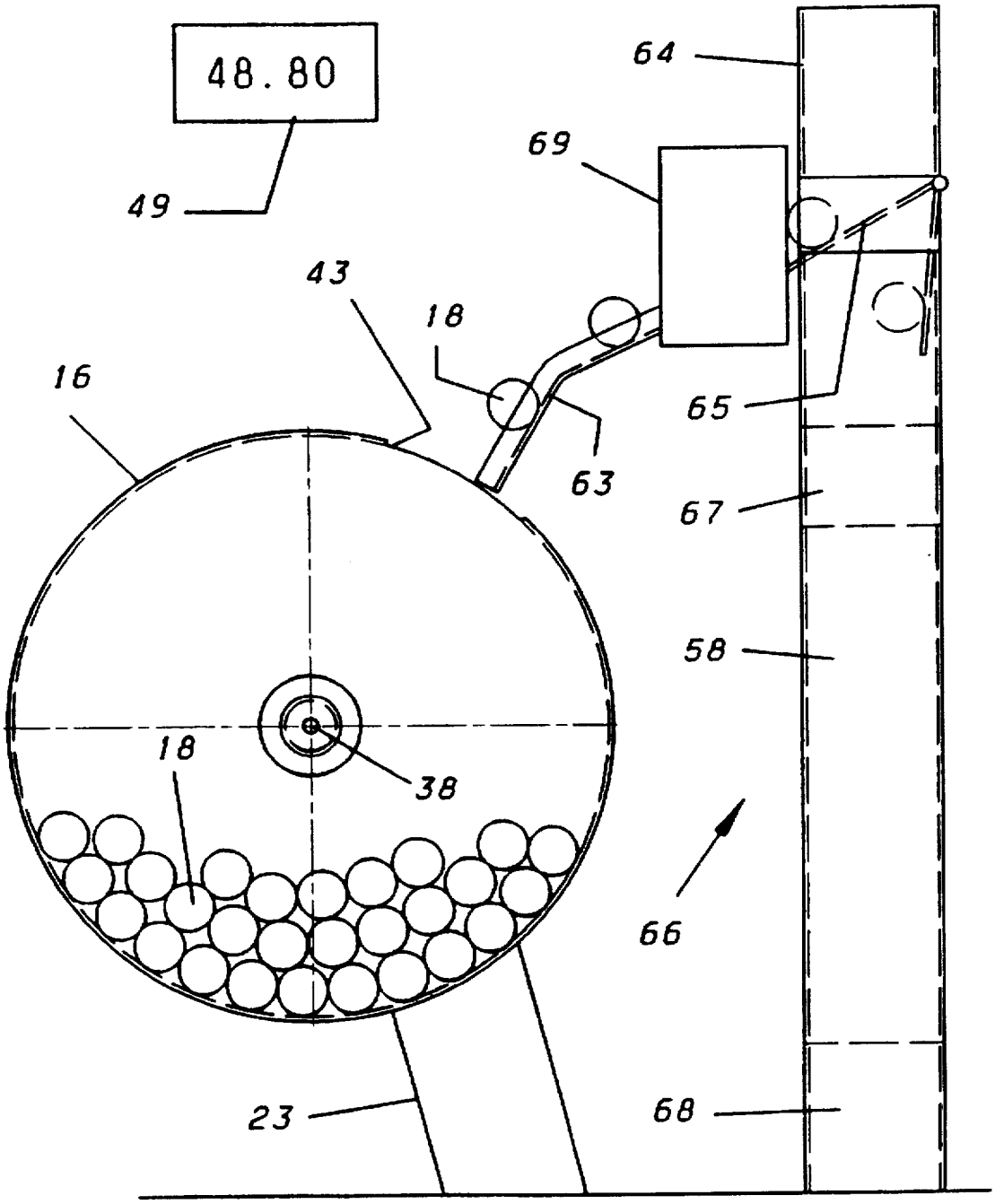
FIG. 7 shows the representation according to FIG. 6 with an intermediate storage for the coins.
Figure 8:
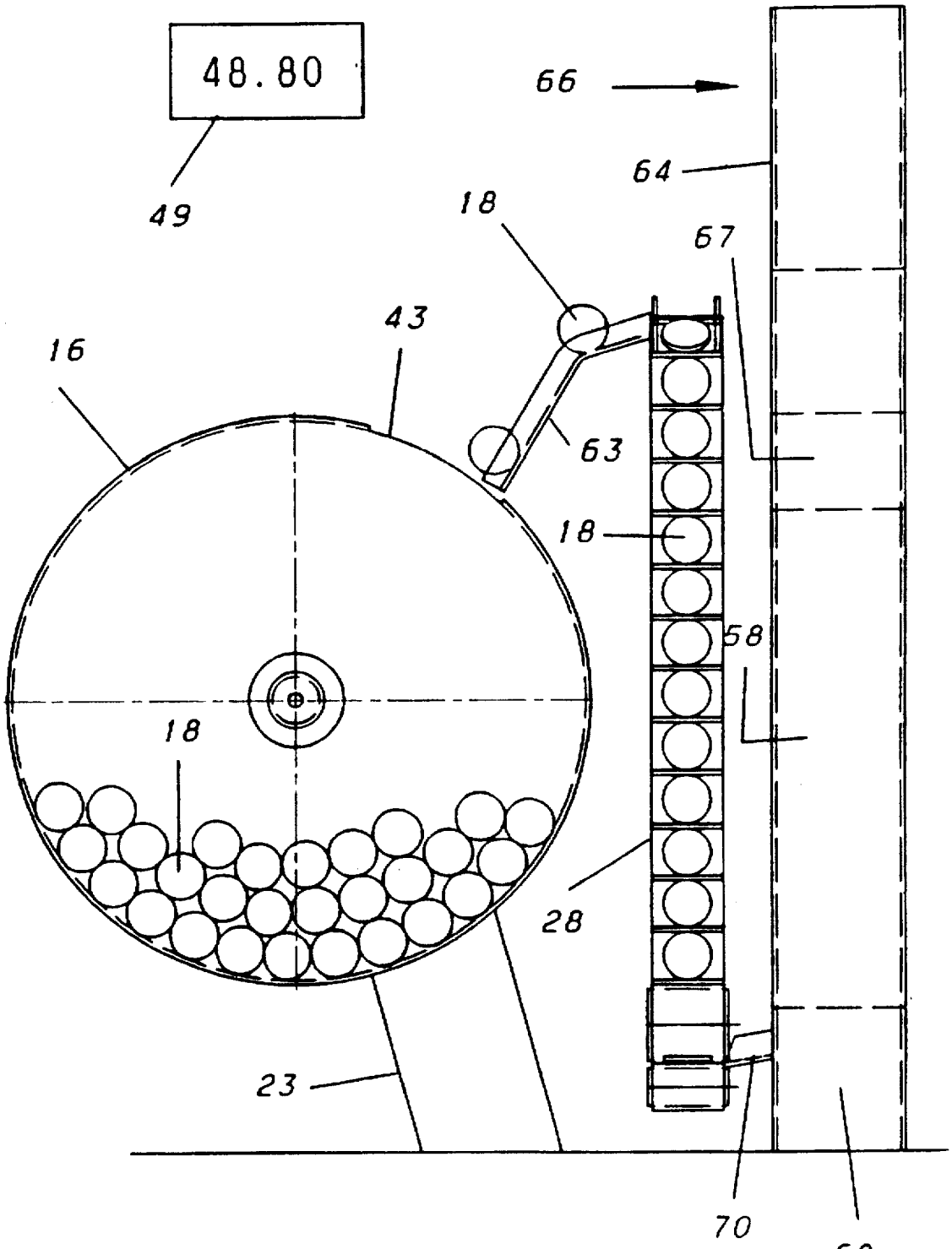
FIG. 8 shows the collection bin according to FIG. 3 with an assigned coin system of the money processing means and a transport means between the coin system and the collection bin.
Figure 9:
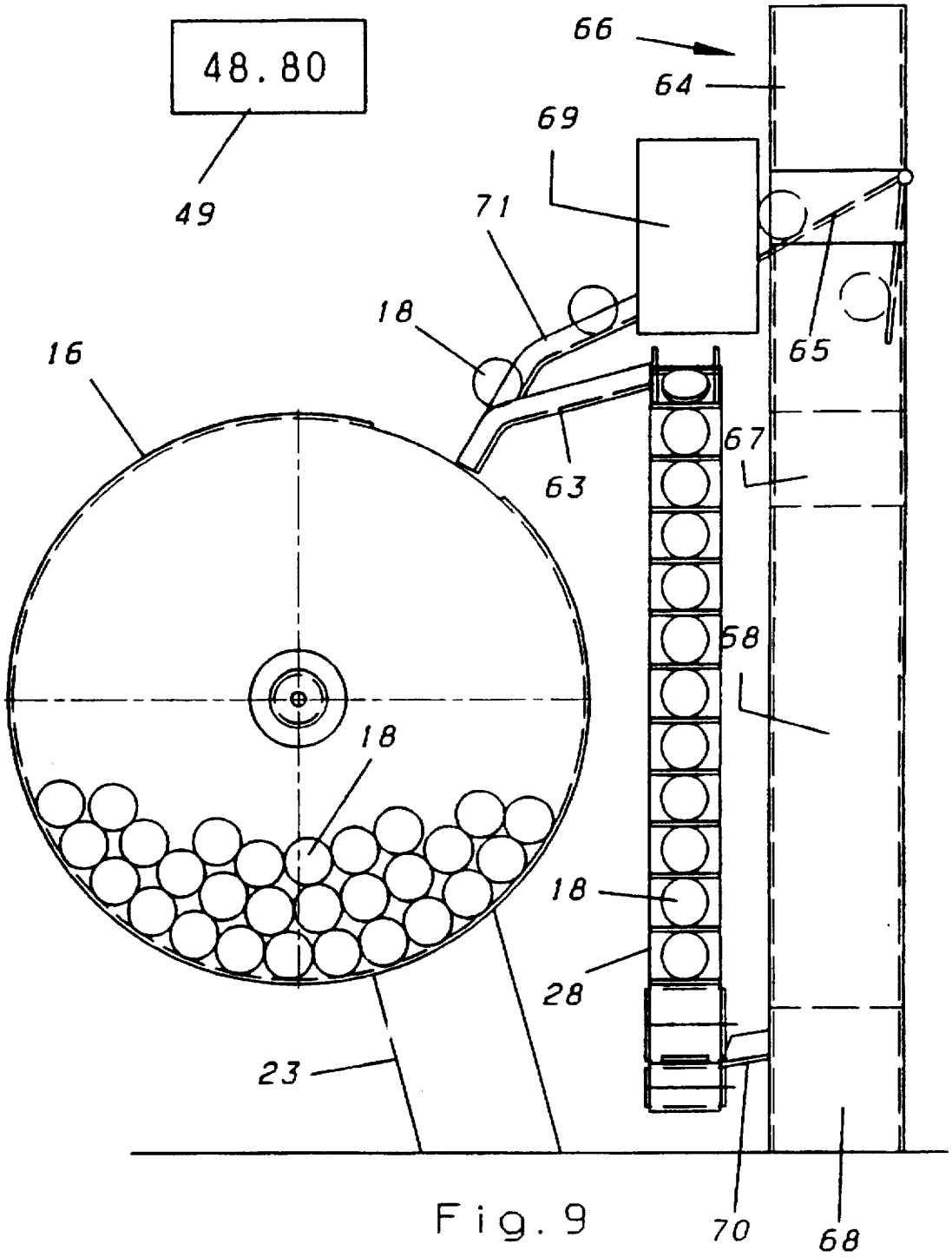
FIG. 9 shows the representation according to FIG. 8 with an intermediate storage for the coins.
Figure 10:
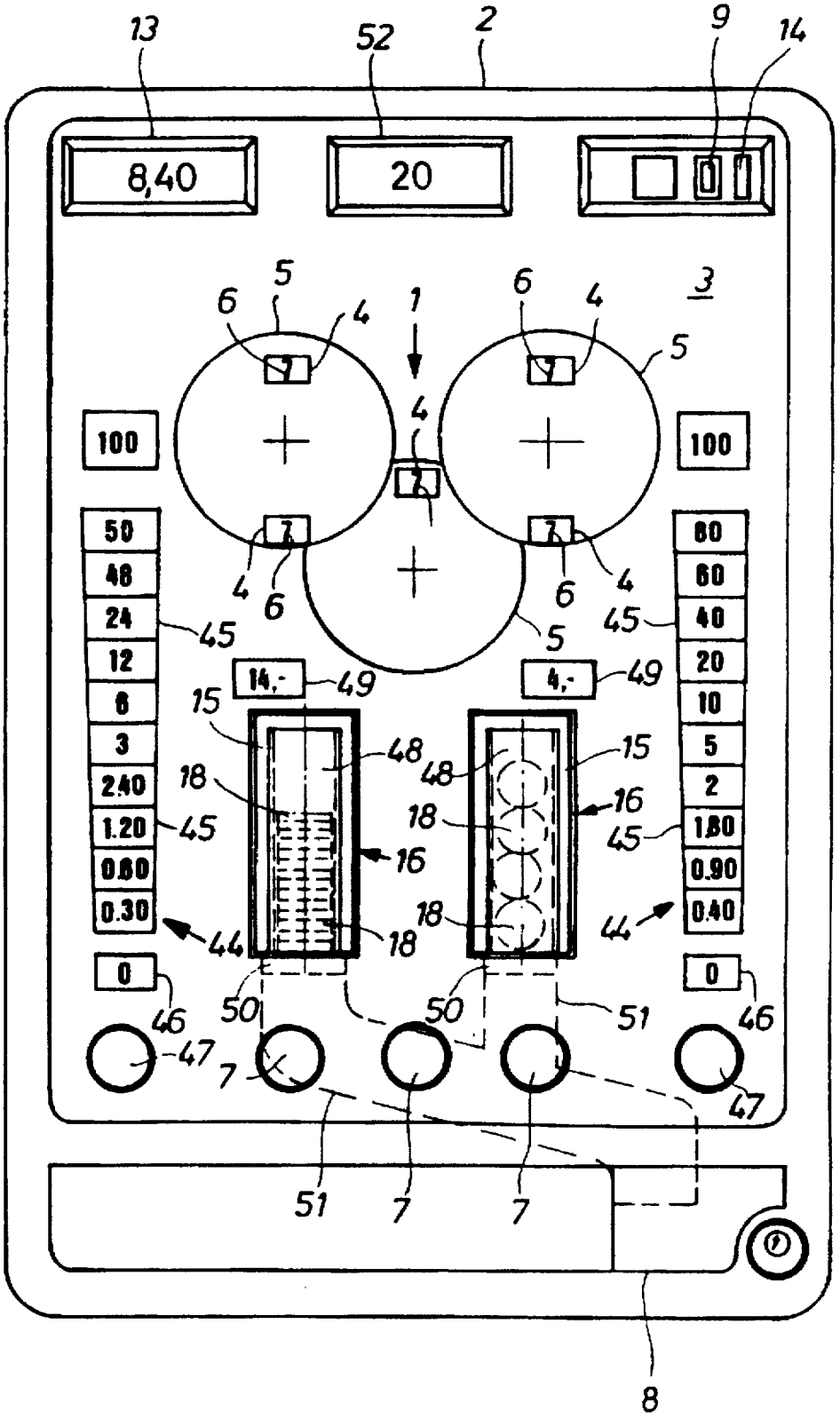
FIG. 10 shows one alternative embodiment of the entertainment device according to FIG. 1.

According to another embodiment collection bin 16 which is provided with input/output opening 43, which can be turned, and which is shown in FIG. 6 holds coins 18 edgewise on top of one another. This collection bin 16 can turn between an upper fill position and a lower emptying position to which guide channel 23 which leads to delivery tray 8 is assigned. In the upper fill position guide rail 63 which guides coins 18 into the edgewise position and which is connected to adjustable shunt 65 of coin system 66 of the money processing means, the shunt located downstream of coin tester 64, is assigned to input/output opening 43. By means of shunt 65 coins 18 can be input either via guide rail 63 into collection bin 16 or via distributor 67 into stacking bin 58. Delivery means 68 via which coins 18 can be supplied to delivery tray 8 is located downstream of stacking bins 58. In the embodiment according to FIG. 7 which corresponds essentially to the representation according to FIG. 6, between guide rail 63 and shunt 65 is intermediate storage 69 for coins 18. Using intermediate storage 69 collection bin 16 can be very quickly filled with a certain number of coins 18 by suddenly opening intermediate storage 69. Alternatively it is also possible to deliver coins 18 individually from intermediate storage 69 by means of an assigned selection means into collection bin 16. In the embodiment according to FIG. 8 which in turn corresponds essentially to the representation according to FIG. 7, the end of guide rail 63 facing away from input/output opening 43 of collection bin 16 is connected to transport means 28 designed as a belt conveyor for coins 18. The feed side of transport means 28 is connected via guide rail 70 and a shunt which is not shown to delivery means 68 of coin system 66. In this way by means of delivery means 68 coins 18 can be conveyed from stacking bins 58 of coin system 69 either into payout tray 8 or via guide rail 70, transport means 28 and guide rail 63 into collection bin 16. The embodiment illustrated in FIG. 9 corresponds essentially to that according to FIG. 8, and includes one guide channel 71 which guides the coins edgewise discharging into guide rail 63. The other end of guide channel 71 is connected to intermediate storage 69 which can be filled with coins 18 via adjustable shunt 65 which is downstream of coin tester 64 of coin system 66. This makes it possible on the one hand to fill collection bin 16 directly with coins 18 inserted into coin tester 64 and on the other hand with coins 18 from stacking bins 58 of coin system 66.

In the embodiments shown in FIGS. 10 through 13 of the entertainment device, the prize won in symbol game means 1 can be transferred by computer control or key control, optionally with the corresponding re-dedication of the prize by the control unit as an insert into one of additional prize game means 44 which are each made as a risk game means with display elements 45 which can be illuminated. Display elements 45 of the two risk game means are each occupied differently in the lower area with increasing money prizes and in the upper area in increasing sequence with the numbers of the special game prizes. A prize obtained in symbol game means 1 which has been transferred by key control or computer control to one of the risk game means is risked by next higher display element 45 with reference to illuminated display element 45 which displays the prize blinking alternately with total loss display element 46 labelled "0" which is assigned to the pertinent risk game means. When corresponding risk key 47 is activated either the next higher prize is won or the prize used is lost. This process can be continued until the highest number of special games is won.

In these entertainment devices in front side 3 of housing 2 are two rectangular viewing windows 15 which are next to one another and behind which there is one transparent coin collecting tube 48 which is used as collection bin 16. In left-hand coin collecting tube 48 coins 18 lie flat on top of one another, while in right-hand coin collecting tube 48 they stand on top of one another edgewise. The actual fill level of coin collecting tubes 48 can therefore be recognized from outside the entertainment device. Coin collecting tubes 48 can contain coins 18 of the same value or different value. Above coin collecting tubes 48 in front side 3 of housing 2 there is one display 49 each which is used to display the total amount of money in pertinent coin collecting tube 48 present at the time. In right-hand display 20 there is displayed a coin content of fourteen 1 DM pieces and in left-hand display 20 a coin content of four 1 DM pieces is displayed.

The upper end of each coin collecting tube 48 is connected via a coin guide tube to a coin shunt which in turn is connected to the coin ejection means of the coin-specific stacking tubes of the money processing means. Coin collecting tubes 48 are filled with at least one coin 18 by computer control via the money processing means depending on the occurrence of certain symbol 6 or a certain symbol combination in viewing windows 4, in which of course corresponding triggering of the coin ejection means of a coin stacking tube and the coin shunt takes place. Another possibility for filling coin collecting tubes 48 consists in computer-controlled introduction of a portion of coins 18 inserted into the money processing means, the remainder of inserted coins 18 being transferred into the coin-specific coin stacking tubes of the money processing means. Furthermore, coin collecting tubes 48 can be filled by introducing at least one coin 18 into certain coin collecting tube 48 by computer control from the money processing means when certain prizes appear in additional prize game means 44.

The lower end of each coin collecting tube 48 is provided with coin ejection means 50 which is joined via coin guide channel 51 to delivery tray 8. Payout of the coins contained in coin collecting tubes 48 takes place when a certain fill level is reached which can be preset or determined randomly via a corresponding triggering of coin ejection means 50 of respective coin collecting tube 48. Another possibility of payout of the coins contained in coin collecting tube 48 consists in that depending on the occurrence of certain symbol 6 or a certain combination of symbols in viewing windows 4, via corresponding triggering of coin insertion means 50 of corresponding coin collecting tube 48 the coins contained in this coin collecting tube are transferred to delivery tray 8. Furthermore, the coins contained in coin collecting tube 48 can be paid out depending on a prize won in additional prize game means 44, coin ejection means 50 of the predetermined coin collecting tube 48 or one selected randomly being correspondingly triggered in order to guide coins 18 of this coin collecting tube 48 into delivery tray 8.

Figure 11:
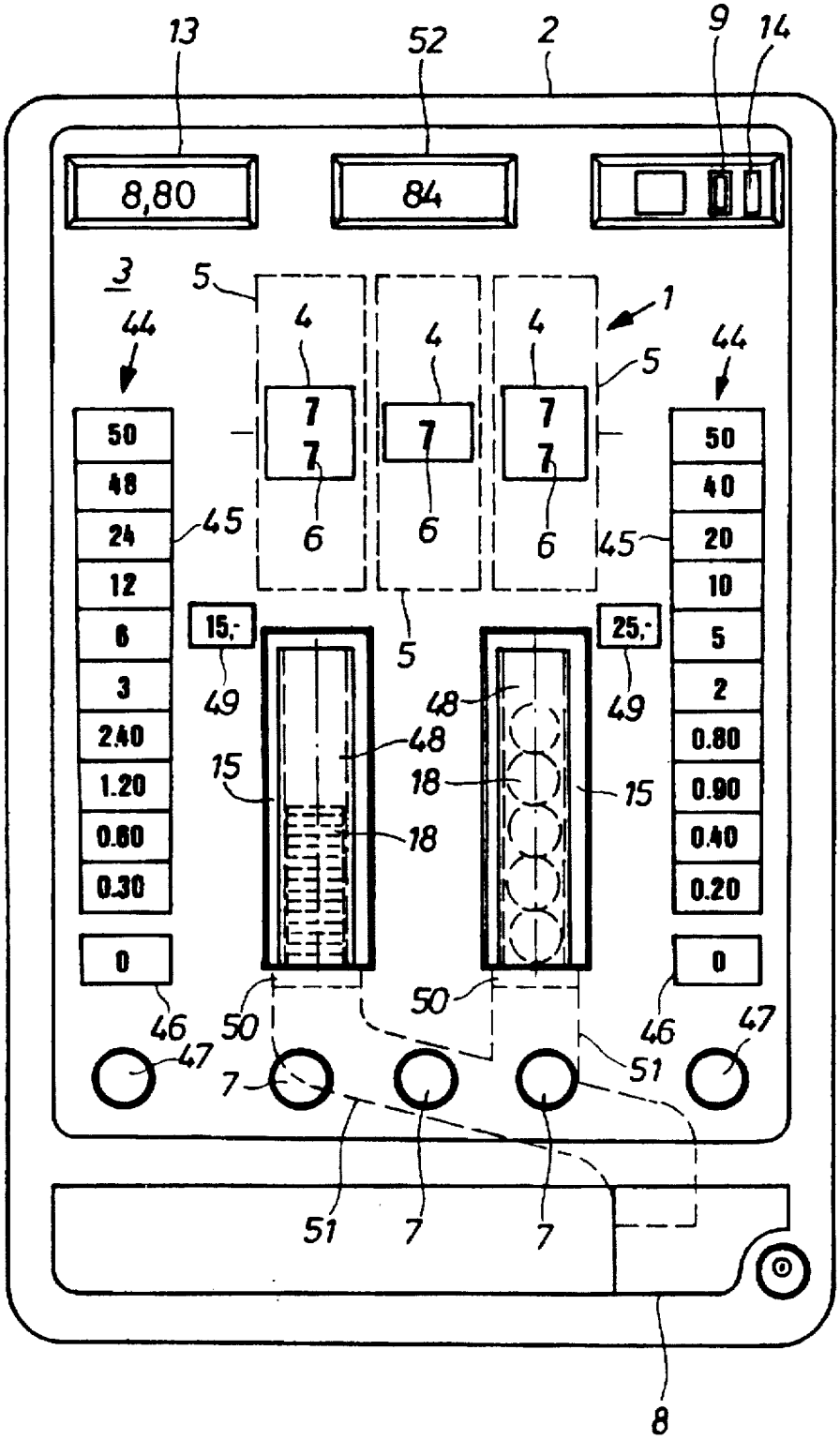
FIG. 11 shows one alternative embodiment of the entertainment device according to FIG. 5.
Figure 12:
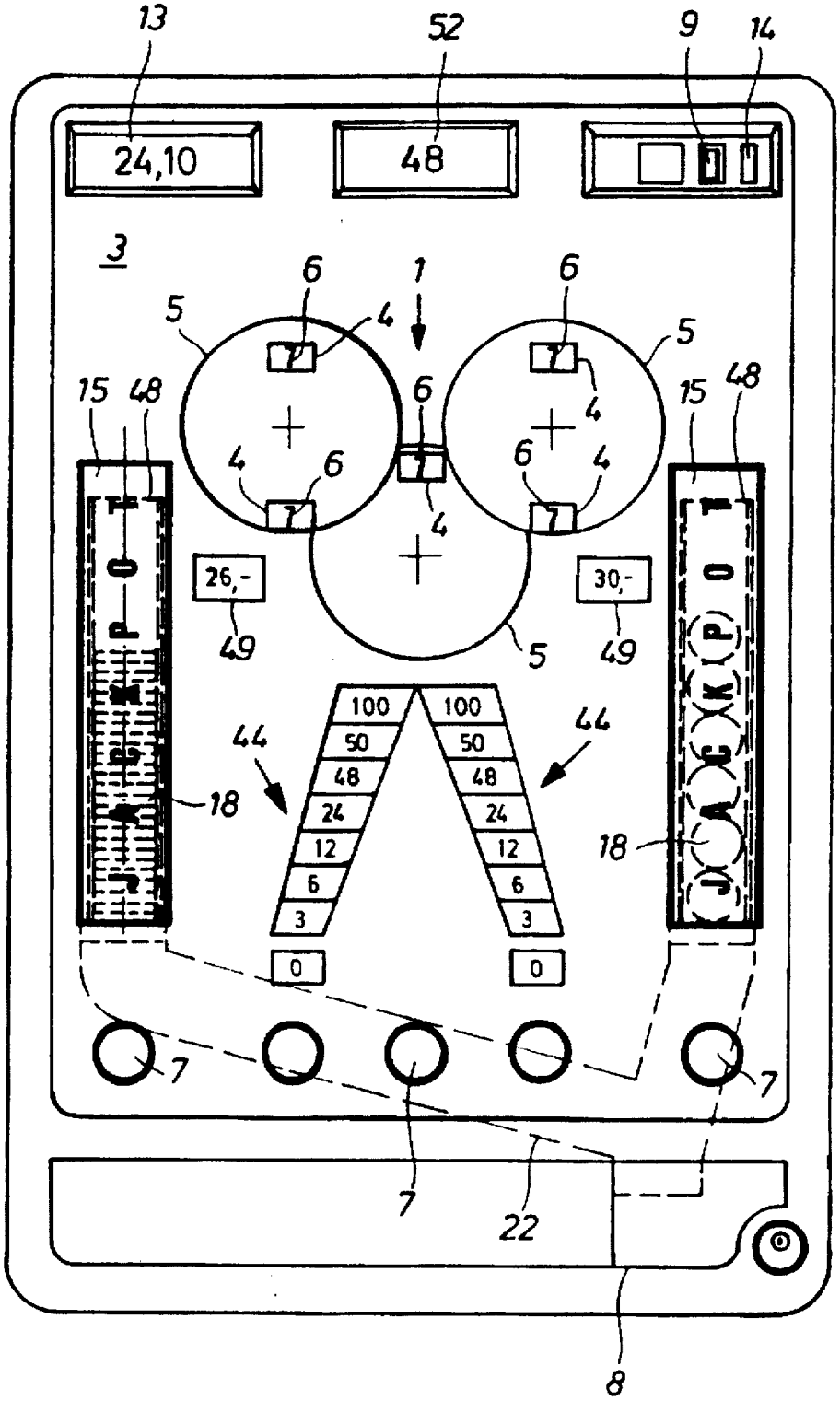
FIG. 12 shows another embodiment of the entertainment device according to the invention.
Figure 13:
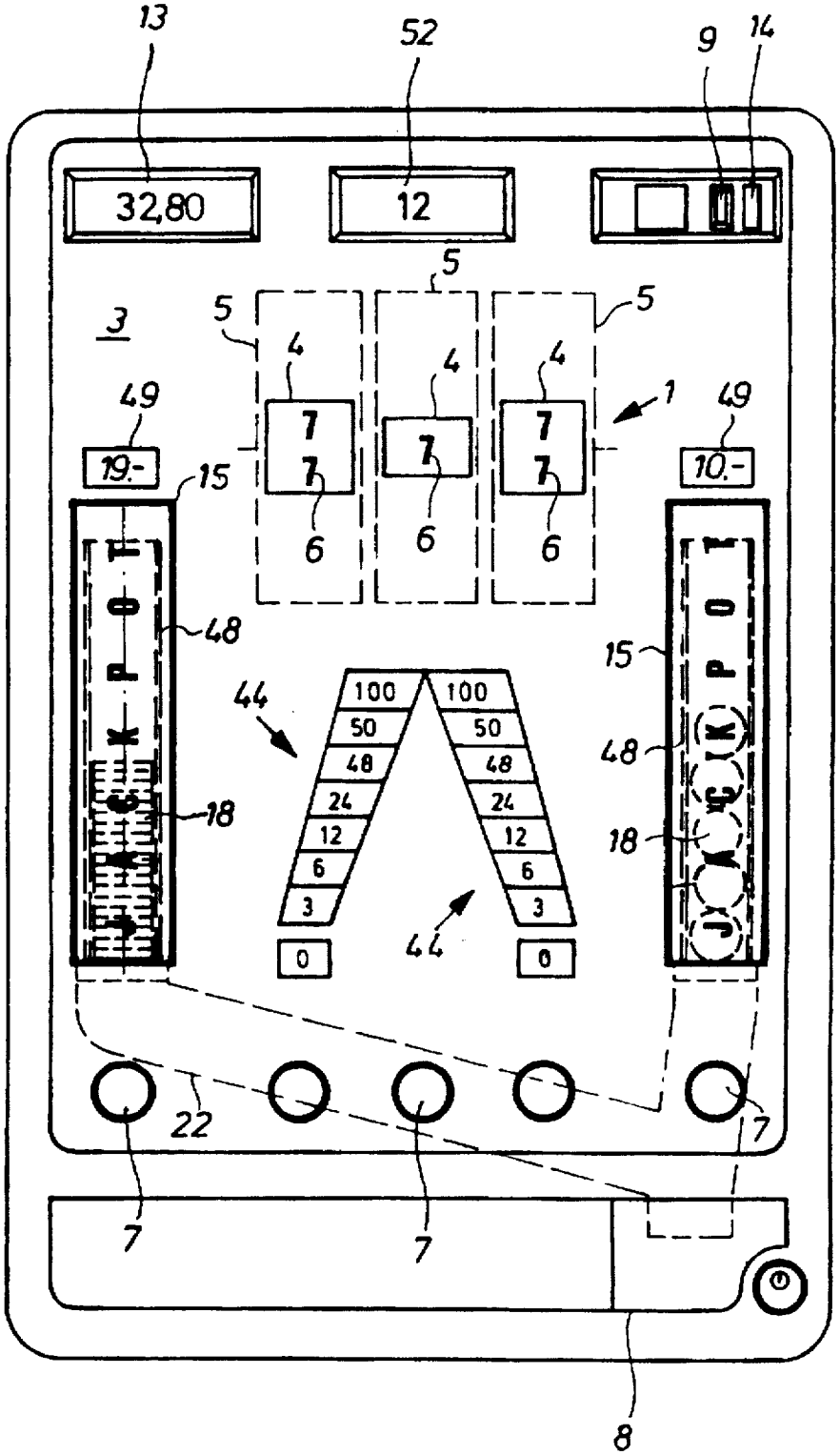
FIG. 13 shows one alternative embodiment of the entertainment device according to FIG. 7.

In the entertainment device shown in FIG. 11 symbol game means 1 comprises roller-shaped rotating bodies 5 which lie in one plane. This makes it possible to make coin collecting tubes 48 located under symbol game means 1 correspondingly larger with pertinent viewing windows 15 compared to disk-shaped rotating bodies 5. In the entertainment device shown in FIG. 12 are two additional prize game means 44 under symbol game means 1 with disk-shaped rotating bodies 5. Coin collecting tubes 48 with pertinent viewing windows 15 are therefore located on the left and right next to symbol game means 1 and accordingly compared to the entertainment devices according to FIGS. 10 and 11 they can be made considerably larger. FIG. 13 shows an entertainment device essentially analogous to the entertainment device according to FIG. 12 in which only rotating bodies 5 of symbol game means 1 are made as rollers.

We claim:

1. A computer-controlled entertainment device operated with at least one of money and money equivalents, comprising:

a housing;

a plurality of viewing windows disposed on the housing;

symbol game means for displaying winning and losing symbol combinations including a plurality of rotating bodies disposed in the housing behind respective ones of the viewing windows;

an optionally selectable additional prize game means for one of playing to completion and accumulating a prize won in the symbol game means;

a money processing means including a value specific stacking means for items of value, a prize delivery mean operatively connected to the stacking means and comprising at least one collection bin for the items of value, the collection bin being configured such that a filling level thereof is visible from a region outside the entertainment device;

a computer control means for filling the collection bin with items of value up to a final total value which is one of predetermined by a computer and fixed by random control at the stacking means;

means for filling the collection bin from the stacking means; and means for filling the collection bin manually.

2. The entertainment device according to claim 1, wherein the computer control means is further adapted to effect a delivery of the items of value from the collection bin responsive to one of a predetermined filling level being reached and a specific predetermined event in one of the symbol game means and the optionally selectable additional prize game means occurring.

3. The entertainment device according to claim 1, further comprising:

a guide channel having an inlet at the collection bin and an outlet;

a delivery tray disposed at the outlet of the guide channel; and means for opening the guide channel for substantially simultaneously delivering all of the items of value disposed in the collection bin into the delivery tray.

4. The entertainment device according to claim 1, further comprising:

a guide channel having an inlet at the collection bin and an outlet;

a delivery tray disposed at the outlet of the guide channel; and selection means operatively connected to the collection bin for delivering the items of value therefrom one of individually and in partial amounts.

5. The entertainment device according to claim 1, wherein the collection bin is configured for containing items of value comprising at least one of coins, currency, tokens, cards of value and articles.

6. The entertainment device according to claim 1, further comprising an item viewing window at a front region of the housing, the collection container being disposed behind the item viewing window and being configured such that the items of value disposed therein are visible through the item viewing window.

7. The entertainment device according to claim 1, wherein the collection bin is one of a jackpot, a prize storage, a credit storage and a risk storage.

8. The entertainment device according to claim 1, further comprising means for displaying the filling level of the collection bin at least one of acoustically and optically.

9. The entertainment device according to claim 1, further comprising a display for displaying an actual total value of the items of value in the collection bin.

10. The entertainment device according to claim 1, wherein given ones of surfaces of the collection bin are at least one of colored and mirrored.

11. The entertainment device according to claim 10, wherein the given ones of the surfaces of the collection bin are illuminated.

12. The entertainment device according to claim 1, wherein the collection bin includes outside surfaces which are at least one of colored and reflective.

13. The entertainment device according to claim 12, wherein the outside surfaces are illuminated.

14. The entertainment device according to claim 1, wherein the collection bin is configured to hold the items of value one of in order and randomly.

15. The entertainment device according to claim 1, further comprising a cover means for partially covering a visible surface of the collection bin.

16. The entertainment device according to claim 15, wherein the cover means is adapted to be actuated to partially cover the visible surface of the collection bin in response to a result of the symbol game means.

17. The entertainment device according to claim 1, wherein the collection bin includes two oppositely disposed scoop-shaped trays, at least one of the trays being swivelably supported for opening and closing the collection bin, the entertainment device further comprising a drive connected to the at least one of the trays for swiveling the at least one of the trays, the collection bin further defining a feed opening therein.

18. The entertainment device according to claim 1, wherein the collection bin comprises a hollow body pivotally mounted at one of a center region thereof and an outside surface thereof, the collection bin further defining a feed and delivery opening therein, the entertainment device further comprising a drive connected to the collection bin for pivoting the collection bin between an upper fill position and a lower delivery position.

19. The entertainment device according to claim 18, further comprising means for closing the feed and delivery opening of the collection bin.

20. The entertainment device according to claim 18, wherein the collection bin is cylindrical and is adapted to hold items of value therein comprising different coins, the collection bin further having a transparent front wall and a transparent back wall separated from one another by a distance larger than a thickness of a thickest one of the coins to be placed in the collection bin and smaller than twice a thickness of a thinnest one of the coins to be placed in the collection bin.

21. The entertainment device according to claim 18, wherein the collection bin is cylindrical and is adapted to hold items of value therein comprising identical coins, the collection bin further having a transparent front wall and a transparent back wall separated from one another by a distance larger than a thickness of the coins for holding the coins within the collection bin edgewise.

22. The entertainment device according to claim 21, wherein the at least one collection bin comprises a plurality of collection bins arranged in succession.

23. The entertainment device according to claim 22, wherein the plurality of collection bins comprise respective cylindrical, coin-value-specific collection bins.

24. The entertainment device according to claim 21, wherein the at least one collection bin comprises a plurality of cylindrical, coin-value-specific collection bins arranged concentrically inside one another.

25. The entertainment device according to claim 1, wherein:

the stacking means comprises a stacking bin; and the prize delivery means comprises a transport means extending from the stacking bin to the collection bin for filling the collection bin with items of value disposed in the stacking bin.

26. The entertainment device according to claim 25, wherein:

the stacking bin defines a removal site for the items of value at an uppermost region thereof; and the prize delivery means comprises:

removal means for removing items of value disposed at the removal site for allowing the items of value to be transported to the collection bin; and movement means disposed at least partially within the stacking bin for moving the items of value within the stacking bin.

27. The entertainment device according to claim 26, further comprising:

a controllable shunt disposed adjacent the removal site; and a delivery tray disposed to receive items of value from the stacking bin, the shunt being controllable for directing the items of value from the stacking bin to the delivery tray both directly and through the collection bin.

28. The entertainment device according to claim 1, wherein the stacking means comprises a stacking bin, the entertainment device further comprising a shunt for routing a portion of items of value inserted into the money processing means, not into the stacking bin, but into the collection bin.

29. The entertainment device according to claim 28, wherein the money processing means comprises:

a money tester;

a shunt connected downstream of the money tester;

an intermediate storage device connected downstream of the shunt; and a selection means connected downstream of the intermediate storage device and disposed between the intermediate storage device and the collection bin, the intermediate storage device further being openable one of for substantially simultaneously delivering all of the items of value disposed therein and for delivering a number of the items of value disposed therein selected by the selection means.

30. The entertainment device according to claim 1, wherein the prize delivery means comprises:

a transport means extending from the stacking means to the collection bin for filling the collection bin with items of value disposed in the stacking means; and a shunt disposed upstream of the transport means for directing a portion of items of value disposed in the money processing means through the transport means into the collection bin.

31. The entertainment device according to claim 1, wherein the prize delivery means comprises:

a money tester;

a transport means extending from the stacking means to the collection bin for filling the collection bin with items of value disposed in the stacking means; and a shunt disposed downstream of the tester and upstream of the transport means for directing a portion of items of value disposed in the money processing means through the transport means into the collection bin.

32. The entertainment device according to claim 1, wherein the prize delivery means comprises a transport means extending from the stacking means to the collection bin for filling the collection bin with items of value disposed in the stacking means, the transport means comprising one of a single conveyor belt, a double conveyor belt and a scoop conveyor.

33. The entertainment device according to claim 1, wherein the money processing means comprises an intermediate storage device openable one of for substantially simultaneously delivering all of the items of value disposed therein and for delivering selected one of the items of value disposed therein, the intermediate storage device comprising one of a hopper and a tubular storage device.

34. The entertainment device according to claim 1, wherein the stacking means is a stacking bin, the entertainment device further comprising:

a delivery tray disposed to receive items of value from the stacking bin;

a depository disposed in the housing so as to not be visible from a region outside of the housing for receiving any items of value delivered from the collection bin; and means for routing items of a value equivalent to the items of value delivered from the collection bin from the stacking bin into the delivery tray.

35. The entertainment device according to claim 34, wherein the collection bin is adapted to be refilled with items of value after the depository has been filled with items of value delivered therefrom and after items of value equivalent to the items of value delivered from the collection bin are routed from the stacking bin into the delivery tray.

* * * * *